United States Patent [19]

Ballard et al.

[11] Patent Number: 4,688,547

[45] Date of Patent: Aug. 25, 1987

[54] METHOD FOR PROVIDING VARIABLE OUTPUT GAS-FIRED FURNACE WITH A CONSTANT TEMPERATURE RISE AND EFFICIENCY

[75] Inventors: Gary W. Ballard; Kevin D. Thompson, both of Indianapolis, Ind.

[73] Assignee: Carrier Corporation, Syracuse, N.Y.

[21] Appl. No.: 889,152

[22] Filed: Jul. 25, 1986

[51] Int. Cl.[4] ..... F24H 3/00; F23N 1/00

[52] U.S. Cl. ..... 126/116 A; 126/110 E; 126/110 R; 236/15 BD; 236/46 R; 236/DIG. 8; 236/DIG. 9; 237/2 A

[58] Field of Search ..... 236/10, 11, 15 BD, 15 BG, 236/46 R, 46 E, 46 F, DIG. 8; 126/110 E, 99 R, 110 R, 116 A; 165/13, 16, 26; 237/2 R, 2 A, 53

[56] References Cited

U.S. PATENT DOCUMENTS

| | | | |
|---|---|---|---|
| 4,267,967 | 5/1981 | Beck et al. | 236/DIG. 9 X |
| 4,270,693 | 6/1981 | Hayes | 236/46 F |
| 4,271,898 | 6/1981 | Freeman | 165/26 X |
| 4,340,355 | 7/1982 | Nelson et al. | 431/12 |
| 4,392,417 | 7/1983 | Johannsen | 126/116 R X |
| 4,394,957 | 7/1983 | Newton, III | 236/46 F X |
| 4,408,713 | 10/1983 | Iijima et al. | 236/DIG. 9 X |
| 4,428,528 | 1/1984 | Renault | 236/46 R |
| 4,502,625 | 3/1985 | Mueller | 236/46 E X |
| 4,576,570 | 3/1986 | Adams et al. | 236/15 BD |
| 4,585,161 | 4/1986 | Kusama et al. | 236/15 BD |

*Primary Examiner*—Larry Jones

*Attorney, Agent, or Firm*—David J. Zobkiw

[57] ABSTRACT

A furnace is operated such that the air-fuel ratio and the temperature rise are maintained constant so that the efficiency remains constant over the range of operation.

2 Claims, 4 Drawing Figures

METHOD FOR PROVIDING VARIABLE OUTPUT GAS-FIRED FURNACE WITH A CONSTANT TEMPERATURE RISE AND EFFICIENCY

BACKGROUND OF THE INVENTION

Furnaces have been available as two-stage or modulating gas-fired types using a modulating or two-stage gas valve and a tapped winding circulating air blower motor. At reduced gas input levels, however, these furnaces operate at excess combustion air and hence at a reduced heating efficiency. Additionally, to maintain a reasonable furnace temperature rise, the blower speed is also reduced. Where a tapped winding, shaded pole or PSC blower motor is used, the efficiency decreases at reduced speeds and the result of a reduced output is a reduced efficiency.

An electrically commutative blower motor (ECM) has an increased electrical efficiency at reduced speeds such that a furnace can provide reduced outputs with no sacrifice in electrical efficiency. The electrical efficiency is, however, only one parameter. The air-fuel ratio is a constant for all burning rates but the combustion air must be supplied in a constant ratio to the fuel by regulating the inducer fan or the manifold gas pressure. When an ECM is used to drive the blower, the increased electrical efficiency with lowering speed must be balanced against the temperature rise in the heat exchanger. The temperature rise in the heat exchanger is normally limited to a maximum 200° F. discharged but an increased discharge temperature has a penalty of decreased heat exchanger life. A reduced temperature rise can result in condensation of the combustion products in the heat exchanger which is permitted by the American Gas Association only upon startup. Also, the temperature rise affects the amount of air circulated and the efficiency of the combustion process.

In addition to balancing out electrical efficiency, the temperature rise, air flow, cycle time and temperature of the discharge air, certain features are desired. Low heat is quiet, provides heat during low demand, and lengthens thermostat cycle time thus decreasing thermal droop. High heat provides heat during high demand and provides preheating of heat exchangers for low fire operation. This all translates into a better comfort level by operating the furnace according to the current needs.

SUMMARY OF THE INVENTION

A constant fuel-air ratio in a condensing furnace is maintained by sensing the combustion air pressure drop across the heat exchanger and adjusting the gas valve output pressure to match the combustion air delivery. Additionally, an ECM that operates at reduced speeds with high efficiency can maintain the air flow at a constant temperature rise.

It is an object of this invention to provide a furnace which can operate at reduced rates to match load conditions without sacrificing thermal or electrical efficiency.

It is another object of this invention to provide a constant temperature rise for all steady-state operating conditions of a furnace. These objects and others as will become apparent hereinafter, are accomplished by the present invention.

Basically, a furnace using an ECM to drive the blower is operated to have a constant air-fuel ratio and a constant temperature rise in all steady-state operating conditions of the furnace.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
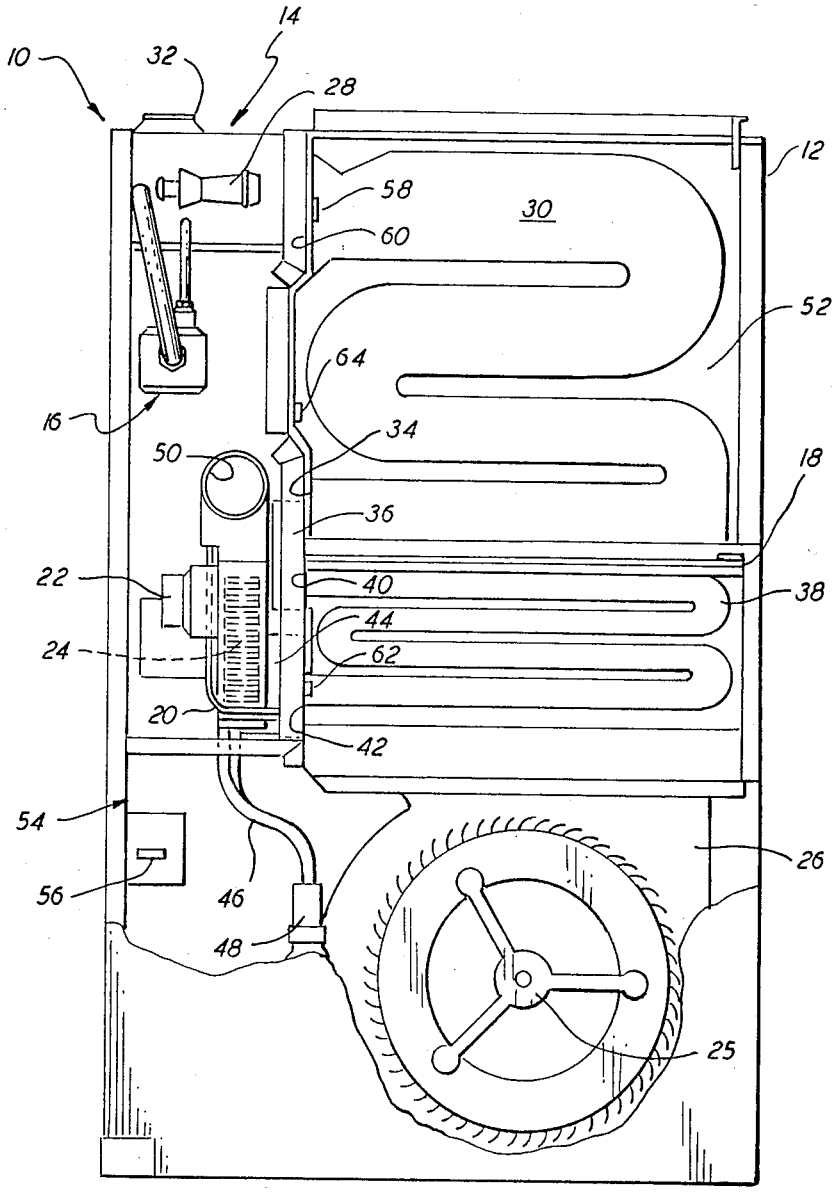
FIG. 1 is a partially cutaway side view of a condensing furnace incorporating the principles of the present invention.

In FIG. 1, the numeral 10 generally designates a gas-fired condensing furnace operated according to the principles of the present invention. Condensing furnace 10 includes a steel cabinet 12 housing therein burner assembly 14, combination gas control or regulator 16, heat exchanger assembly 18, inducer housing 20 supporting inducer motor 22 and inducer wheel 24, and circulating air blower 26. Combination gas control 16 includes pilot circuitry for controlling and providing the pilot flame.

Burner assembly 14 includes at least one inshot burner 28 for at least one primary heat exchanger 30. Burner 28 receives a flow of combustible gas from gas regulator 16 and injects the fuel gas into primary heat exchanger 30. A part of the injection process includes drawing air into heat exchanger assembly 18 so that the fuel gas and air mixture may be combusted therein. A flow of combustion air is delivered through combustion air inlet 32 to be mixed with the gas delivered to burner assembly 14.

Primary heat exchanger 30 includes an outlet 34 opening into chamber 36. Connected to chamber 36 and in fluid communication therewith are at least four condensing heat exchangers 38 having an inlet 40 and an outlet 42. Outlet 42 opens into chamber 44 for venting exhaust flue gases and condensate.

Inducer housing 20 is connected to chamber 44 and has mounted thereon an inducer motor 22 together with inducer wheel 24 for drawing the combusted fuel air mixture from burner assembly 14 through heat exchanger assembly 18. Air blower 26 is driven by electronically commutated motor (ECM) 25 and delivers air to be heated upwardly in a counterflow arrangement through air passage 52 and over heat exchanger assembly 18. The cool air passing over condensing heat exchanger 38 lowers the heat exchanger wall temperature below the dew point of the combusted fuel air mixture causing a portion of the water vapor in the combusted fuel air mixture to condense, thereby recovering a portion of the sensible and latent heat energy. The condensate formed within heat exchanger 38 flows through chamber 44 into drain tube 46 to condensate trap assembly 48. As air blower 26 continues to urge a flow of air upwardly through heat exchanger assembly 18, heat energy is transferred from the combusted fuel air mixture flowing through heat exchangers 30 and 38 to heat the air circulated by blower 26. Finally, the combusted fuel air mixture that flows through heat exchangers 30 and 38 exits through outlet 42 and is then delivered by inducer motor 22 through exhaust gas outlet 50 and thence to a vent pipe (not illustrated).

Cabinet 12 also houses microprocessor control assembly 54, LED display 56, pressure tap 58 located at primary heat exchanger inlet 60, pressure tap 62 located at condensing heat exchanger outlet 42 and limit switch 64 disposed in air passage 52. In a non-condensing furnace, pressure tap 62 would be disposed at primary heat exchanger outlet 34, since there would be no condensing heat exchanger 38.

Figure 2:
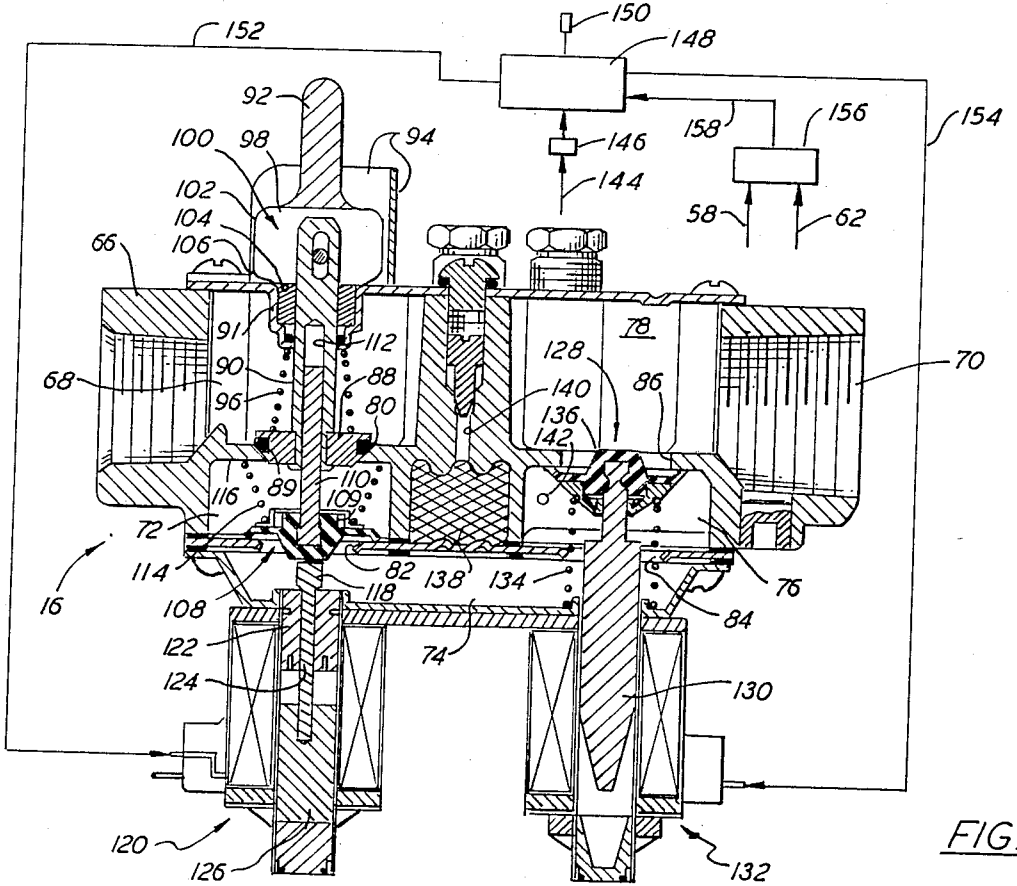
FIG. 2 is a sectional view of a gas supply valve together with a schematic representation of the furnace control system.

Referring now to FIG. 2, gas regulator 16 generally comprises valve body 66 having an inlet 68 and an outlet 70. Between inlet 68 and outlet 70 are a series of chambers, specifically, inlet chamber 72, intermediate chamber 74, regulator chamber 76, and main chamber 78. These chambers are in fluid communication, directly or indirectly, with valve body inlet 68 and outlet 70. Inlet 68 communicates with inlet chamber 72 through inlet chamber seat 80. Inlet chamber 72 communicates with intermediate chamber 74 through intermediate chamber seat 82. Intermediate chamber 74 communicates with regulator chamber 76 through regulator seat 84. Regulator chamber 76 communicates with main chamber 78 through main seat 86, and main chamber 78 communicates with outlet 70. The use of the term "seat", as used here, is equivalent to terms such as "opening", "hole", and the like.

Each of the above mentioned seats are closed and opened by particular members. Inlet chamber seat 80 is closed and opened by manually-operated valve head 88. Valve head 88 is connected to and movable with plunger 90, which is slidably received through valve body 66 in a fluid-tight manner. The externally remote end of plunger 90 is suitably connected to manual on-off lever 92, which is surrounded by indicator bracket 94. Bracket 94 is connected to valve body 66 in any suitable manner. Spring 96 is disposed within inlet 68 and between valve head 88 and the valve top cover plate 91 so as to bias valve head 88 into seating engagement with inlet chamber seat 80, thereby to prevent fluid communication between inlet 68 and inlet chamber 72. O-ring 89 insures a fluid tight fit between valve head 88 and seat 80. To open or move valve head 88 to an open position to allow fluid communication between inlet 68 and inlet chamber 72, manual on-off lever 92 is rotated in a counter-clockwise direction, as viewed in FIG. 2. Manual on-off lever 92 includes an enlarged end portion 98 that has a camming surface 100. Camming surface 100 is defined by two relatively flat surfaces 102 and 104 that are generally perpendicularly disposed with respect to each other and joined by a generally curved surface 106. As seen in FIG. 2, manual lever 92 is in the closed position so that spring 96 is biasing valve head 88 into seating engagement with inlet chamber seat 80 in a fluid-tight manner. As manual lever 92 is rotated counter-clockwise, the action of camming surface 100 and enlarged end portion 98 causes plunger 90 to be pulled upwardly against the force of spring 96 unseating valve head 88 from inlet chamber seat 80, thereby enabling gas regulator 16 by permitting fluid communication between inlet 68 and inlet chamber 72. Manual lever 92 is held in the open position by the engaging force or friction existing between flat surface 102 and the flat exterior surface portion of valve body 66. Naturally, to close inlet chamber seat 80, manual lever 92 is rotated clockwise to permit spring 96 to extend plunger 90 downwardly thereby permitting valve head 88 to engage inlet chamber seat 80 and disable gas regulator 16.

Intermediate chamber seat 82 is opened and closed by valve 108, which is disposed in inlet chamber 72. Valve 108 includes a valve disc 109 with secondary plunger 110 connected thereto in any suitable manner. Secondary plunger 110 is slidably received in bore 112 formed in plunger 90. Spring 114 is disposed in inlet chamber 72 between valve disc 109 and oppositely disposed inlet chamber upper surface 116. Spring 114 biases valve disc 109 downwardly to close intermediate chamber seat 82 in a fluid tight manner. Valve disc 109 is made of rubber to insure a fluid tight fit between chamber 72 and chamber 74. Valve disc 109 is connected to secondary plunger 110 so that valve disc 109 moves in a generally vertical or straight line direction generally perpendicular to the plane of intermediate chamber seat 82, thereby insuring a fluid tight closure of intermediate chamber seat 82 when valve disc 109 is in the closed position, as illustrated in FIG. 2. Disposed on the opposite side of valve disc 109 and in general axial alignment with secondary plunger 110 is push rod 118. Push rod 118 abuts against the undersurface of valve disc 109, and upon being moved in an upwardly direction, push rod 118 moves valve disc 109 upwardly against spring 114 to open intermediate chamber seat 82, thereby permitting fluid communication between inlet chamber 72 and intermediate chamber 74. Push rod 118 is moved in an up and down direction, as viewed in FIG. 2, by pick and hold solenoid 120. Solenoid 120 is connected to valve body 66 in any suitable manner and includes a joining segment 122 extending slightly inwardly of intermediate chamber 74. Joining segment 122 provides a fluid tight fit or connection between solenoid 120 and intermediate chamber 74. Joining segment 122 has an axial passage 124 for slidably receiving push rod 118 therein, with the lower remote end of push rod 118 being fixed loosely to movable plunger 126 of solenoid 120. When solenoid 120 is in a de-energized state, plunger 126 and push rod 118 are located in a lowermost position, as illustrated in FIG. 2, so that spring 114 biases valve seat disc 108 in fluid tight engagement with intermediate chamber seat 82. Upon energizing solenoid 120, plunger 126 and push rod 118 move upwardly against valve disc 109 and the bias of and spring 114 to thereby open intermediate chamber seat 82 to allow fluid communication between inlet chamber 72 and intermediate chamber 74.

The fluid communication between intermediate chamber 74, regulator chamber 76, and main chamber 78 are closely related in that the opening and closing of regulator seat 84 and main seat 86 are controlled by a single regulator valve disc 128 disposed in regulator chamber 76. It should be noted that regulator seat 84 and main seat 86 are generally oppositely disposed from each other in regulator chamber 76 and are in generally axial alignment with each other, whereby the axial or linear movement of regulator valve disc 128 regulates the fluid communication between intermediate chamber 74, regulator chamber 76, and main chamber 78. Regulator valve disc 128 is connected in any suitable manner to regulator plunger 130 of regulator solenoid 132. A spring 134 is disposed against the underside of regulator valve disc 128 and through regulator seat 84, and biases regulator valve disc 128 upwardly to close main seat 86 in a fluid tight fashion. The upper portion 136 of regulator valve disc 128 is made of a rubber material to ensure fluid tight engagement between valve disc 128 and main seat 86. Regulator valve disc 128 is moved downwardly from its uppermost position, where it opens main seat 86, to a lowermost position where it closes regulator seat 84, thereby permitting fluid communication between regulator chamber 76 and main chamber 78. Regulator valve disc 128 is moved to its lowermost position upon energizing regulator solenoid 132, which pulls regulator plunger 130 downwardly against the bias of spring 134 until valve disc 128 seats against regulator seat 84. By controlling the voltage to regulator solenoid 132, which will be explained in greater detail below, regulator valve disc 128 is positionable to an infinite number of positions between its uppermost position where it closes main seat 86 and its lowermost position where it closes regulator seat 84. Naturally, any position, other than the uppermost and lowermost positions, will provide simultaneous fluid communication between intermediate chamber 74, regulator chamber 76, and main chamber 78.

Disposed in fluid communication with intermediate chamber 74 are pilot filter 138 and pilot conduit 140 for respectively filtering the portion of the gas flowing through filter 138 and delivering it through pilot conduit 140 to the pilot flame assembly, which is part of gas regulator 16.

Figure 3:
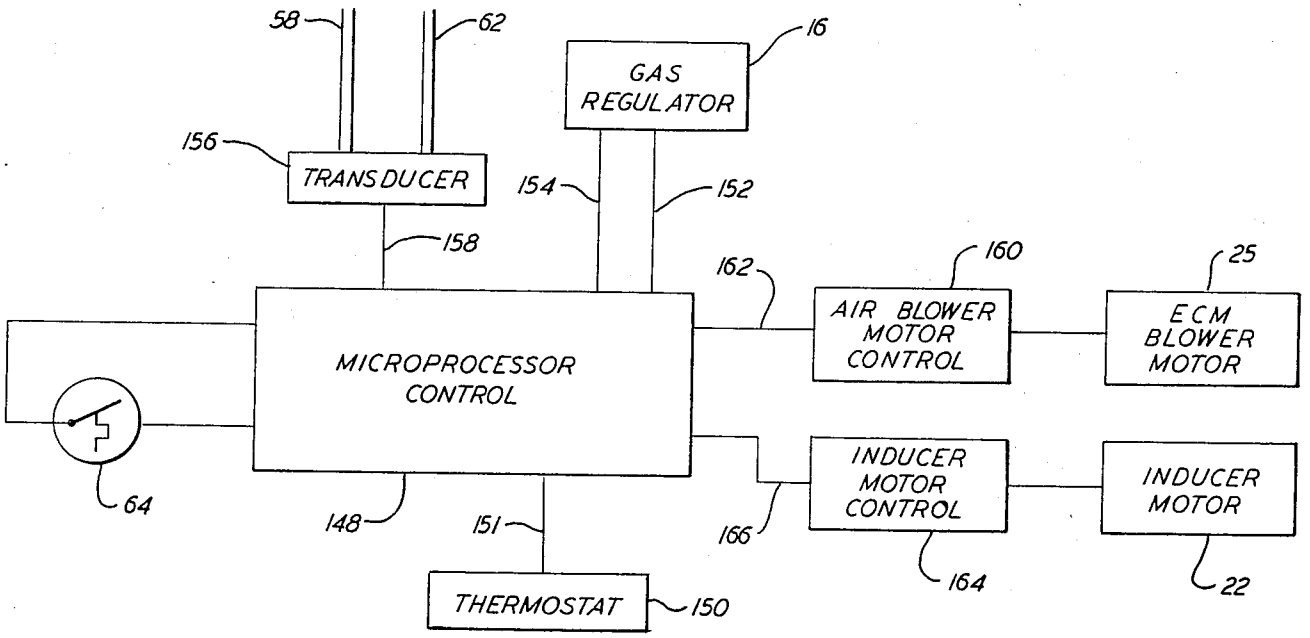
FIG. 3 is a block diagram of a portion of the furnace control system.

A pressure-tap port 142 is disposed in regulator chamber 76 for transmitting variations in fluid pressure from chamber 76 through line 144 to pressure transducer 146. Pressure transducer 146 then generates an analog signal to microprocessor control 148 indicative of a change in fluid pressure in regulator chamber 76. Microprocessor control 148 which is illustrated in FIGS. 2 and 3 is located in microprocessor control assembly 54 in condensing furnace 10, and is capable of being preprogrammed to generate a plurality of control signals in response to received input signals. Microprocessor control 148 is also connected electrically to thermostat 150 to receive signals therefrom, to pick and hold solenoid 120 by electrical lines 152, and to regulator solenoid 132 by electrical lines 154.

The simplified block diagrams of FIGS. 2 and 3 illustrate the interconnection between microprocessor control 148 and pressure taps 58 and 62 through differential pressure transducer 156 which generates an analog signal indicative of the differential pressure. Microprocessor control 148 is also electrically connected to limit switch 64, to gas regulator 16 through electrical lines 152 and 154, to air blower motor control 160 of ECM 25 of air blower 26 through electrical lines 162, to inducer motor control 164 of inducer motor 22 through electrical lines 166 and to thermostat 150 through electrical lines 151. Air blower motor control 160 and inducer motor control 164 respectively control the rate of fluid flow created by air blower 26 and inducer wheel 24. After ignition of the pilot flame of gas regulator 16, a signal is generated to microprocessor control 148 through electrical lines 152 and 154 to indicate that the flame is proved.

During this period of time, microprocessor control 148 is monitoring the pressure drop access heat exchanger assembly 18 through pressure taps 58 and 62 which transmit pressure readings to differential pressure transducer 156. Differential pressure transducer 156 sends a pressure differential signal indicative of the pressure drop across heat exchanger assembly 18 through electrical lines 158 to microprocessor control 148. After microprocessor control 148 determines that a sufficient pressure drop exists across heat exchanger assembly 18, that the gas pressure in gas regulator 16 is at or above a predetermined pressure, and the pilot flame has been proved, microprocessor control 148 is programmed to generate a voltage signal through electrical lines 152 and 154 to solenoids 120 and 132 in regulator 16 for controlling gas flow.

Because of the relatively high pressure existing in regulator chamber 76, the signal generated from microprocessor control 148 to regulator solenoid 132 is of a relatively high voltage to cause solenoid 132 to pull regulator plunger 130 to its lowermost position, whereby regulator valve disc 128 opens main seat 86 and closes regulator seat 84. This prevents fluid communication between regulator chamber 76 and intermediate chamber 74, but does permit fluid communication between regulator chamber 76 and main chamber 78. Thus, the increased gas pressure in regulator chamber 76 bleeds off through main seat 86, main chamber 78 and through outlet 70. This decreasing gas pressure in regulator chamber 76 is continually monitored by microprocessor control 148 through port 142 and upon reaching a predetermined low pressure, microprocessor control 148 generates a relatively low voltage signal to regulator solenoid 132 to open regulator seat 84 by moving regulator plunger 130 to an intermediate position between its uppermost position where it closes off main seat 86 and its lowermost position where it closes off regulator seat 84. Microprocessor control 148 is preprogrammed to position regulator valve disc 128 in regulator chamber 76 to provide a desired gas flow rate and pressure in main chamber 78.

Gas flow is provided by gas control 16 to burner assembly 14 and the fuel air mixture is combusted by inshot burner 28. The combusted fuel air mixture is then drawn through heat exchanger assembly 18 and out exhaust gas outlet 50 by the rotation of inducer wheel 24 by motor 22. After a preselected period of time, for example, one minute, to ensure heat exchanger assembly 18 has reached a predetermined temperature, microprocessor control 148 is preprogrammed to generate a signal through electrical lines 162 to air blower motor control 160, which starts ECM 25 of air blower 26 to provide a flow of air to be heated over condensing heat exchanger 38 and primary heat exchanger 30. Any condensate that forms in condensing heat exchanger 38 is delivered through drain tube 46 to condensate trap assembly 48. After the heating load has been satisfied, the contacts of the thermostat 150 open, and in response thereto microprocessor control 148 de-energizes gas regulator 16 ceasing the supplying of fuel. This naturally causes the pilot flame and burner flame to be extinguished.

After gas control 16 is de-energized, microprocessor control 148 generates a signal over electrical lines 166 to inducer motor control 164 to terminate operation of inducer motor 22. After inducer motor 22 has been de-energized, microprocessor control 148 is further preprogrammed to generate a signal over lines 162 to air blower motor control 160 to de-energize ECM 25, thereby terminating operation of air blower 26, after a preselected period of time, for example, 60–240 seconds. This continual running of air blower 26 for this predetermined amount of time permits further heat transfer between the air to be heated and the heat being generated through heat exchanger assembly 18, which also naturally serves to cool heat exchanger assembly 18.

Because the pressure drop across heat exchanger assembly 18 can vary due to changing conditions or parameters, microprocessor control 148 is preprogrammed to ensure an optimum manifold gas pressure as a function of the amount of combustion air flowing through combustion air inlet 32 under the influence of inducer wheel 24. As previously described, the pressure drop across heat exchanger assembly 18 is measured by pressure taps 58 and 62 which transmit their individual pressure readings to differential pressure transducer 156. Transducer 156 then generates a pressure differential signal to microprocessor control 148 over electrical lines 158 indicative of the pressure drop across heat exchanger assembly 18. An empirically determined equation for optimum manifold gas pressure versus heat exchanger pressure drop, as described below, is programmed into microprocessor control 148 whereby it determines the optimum manifold gas pressure for a particular pressure drop across heat exchanger assembly 18, as indicated by the pressure differential signal received from differential pressure transducer 156. As the pressure drop varies, microprocessor control 148 generates a signal to gas regulator 16 over electrical lines 152 and 154 to regulate the fuel supply. During continued operation of furnace 10, microprocessor control 148 continues to make adjustments in the gas flow rate and pressure as a function of certain variable parameters, such as line pressure, dirty filters, closed ducts, supply voltage, temperature changes, vent pipe length, furnace altitude, and the like. Thus, gas control 16 and microprocessor control 148 provide essentially an infinite number of gas flow rates between a zero flow rate and a maximum flow rate in a selected range of, for example, two inches to fourteen inches W.C. (water column).

Determination of insufficient or too much combustion air flowing through combustion air inlet 32 is determined by the pressure drop across heat exchanger assembly 18 as previously described. Generally, for each pressure differential value, there is one optimum manifold gas pressure and one optimum combustion air flow rate. Thus, assuming the manifold gas pressure is substantially constant, variations in certain parameters can require adjustment to the combustion air flow rate as provided by inducer wheel 24.

Upon determining insufficient combustion air flow through burner assembly 14, as indicated by a low pressure drop across heat exchanger assembly 18, microprocessor control 148 generates a speed increase signal to inducer motor control 164 to increase the combustion air flow rate through burner assembly 18 and increase the pressure drop across heat exchanger assembly 18. In a similar manner, microprocessor control 148 can determine insufficient flow of air to be heated through furnace 10 by activation of temperature limit switch 64 which will close when the temperature in air passage 52 exceeds a predetermined temperature limit.

To enable the device, the manual on-off lever 92 is moved in a counter-clockwise position to open inlet chamber seat 80. Upon the closing of the contacts in thermostat 150 indicating a need for heat, microprocessor control 148 is programmed to send a signal via electrical lines 166 (FIG. 4) to inducer motor control 164 to start inducer motor 22 to rotate inducer wheel 24, thereby causing a flow of combustion air through combustion air inlet 32, burner assembly 14, heat exchanger assembly 18, inducer housing 20, and out exhaust gas outlet 50. After a predetermined period of time, for example, ten seconds, to ensure purging of the furnace, microprocessor control 148 generates a signal through electrical lines 152 to pick and hold solenoid 120, thereby energizing it to move plunger 126 upwardly so that push rod 118 separates valve disc 109 from intermediate chamber seat 82 to permit gas flow from inlet chamber 72 to intermediate chamber 74. The gas flows then to and through pilot filter 138 and pilot conduit 140 to initiate the pilot flame, and flows also into regulator chamber 76 where the pressure is sensed at pressure-tap port 142 which is connected to pressure transducer 146 which supplies a signal to microprocessor control 148 for controlling the supply of gas to burner 28.

The present invention employs an adaptive microprocessor control for providing a low heat mode and a high heat mode of a heating cycle in furnace 10 as a function of the previous heating cycle, particularly the length of time of operation of the previous heating cycle's low heat mode, high heat mode, and the duration of time between the end of the previous heating cycle and the beginning of the new heating cycle. The adaptive control optimizes the time the furnace operates in the low heat mode, which is approximately 67% of the high heat mode, thereby minimizing energy consumption and providing a more efficient furnace. This adaptive microprocessor control is disclosed in commonly assigned application Ser. No. 803,374 filed Dec. 2, 1985 now patent number 4,638,942 and entitled AN ADAPTIVE MICROPROCESSOR CONTROL SYSTEM AND METHOD FOR PROVIDING HIGH AND LOW HEATING MODES IN A FURNACE which is hereby incorporated herein by reference.

In order to properly control the blower 26, it is necessary to be able to determine the reference RPM and CFM of the blower at the beginning of each thermostat cycle. Suitable techniques for determining the reference RPM, $RPM_{ref}$, and CFM, $CFM_{ref}$, are disclosed in commonly assigned application Ser. No. 809,466 filed Dec. 16, 1985 entitled CALIBRATION TECHNIQUE FOR VARIABLE SPEED MOTORS, and application Ser. No. 877,613 filed June 23, 1986 now patent number 4,648,551 entitled ADAPTIVE BLOWER MOTOR CONTROLLER which are hereby incorporated herein by reference.

The desired CFM, $CFM_{des}$, is determined as follows:

$$CFM_{des}=(Q\eta)/(1.088TR)$$

where

Q is the input in BTU/hr $\eta$ is the steady state efficiency

TR is the temperature rise.

Using Bernoulli's equation, $$(MP_1)/(MP_2)=(Q_1/Q_2)^2$$

where MP is the manifold pressure.

If $MP_1=3.5$ inches of water column when $$Q_1=20000/\eta \text{ per cell}$$

then $$Q_2 = \{10690.45\sqrt{MP_2}\}/\eta \text{ per cell}$$

Accounting for the number of cells, N, $$CFM_{des}(=Q_2\eta N)/(1.088TR)$$

substituting for $Q_2$ $$CFM_{des} = (9825.78 \sqrt{MP_2}\ N)/TR \quad \text{(Eq 1)}$$

The desired RPM, $RPM_{des}$, is obtained from the fan laws wherein $$(RPM_{ref}/RPM_{des}) = (CFM_{ref}/CFM_{des})$$

thus $$RPM_{des} = [(RPM_{ref})(CFM_{des})]/CFM_{ref} \quad \text{(Eq 2)}$$

As noted above, calibration procedures are available for determining $RPM_{ref}$ and $CFM_{ref}$.

Figure 4:
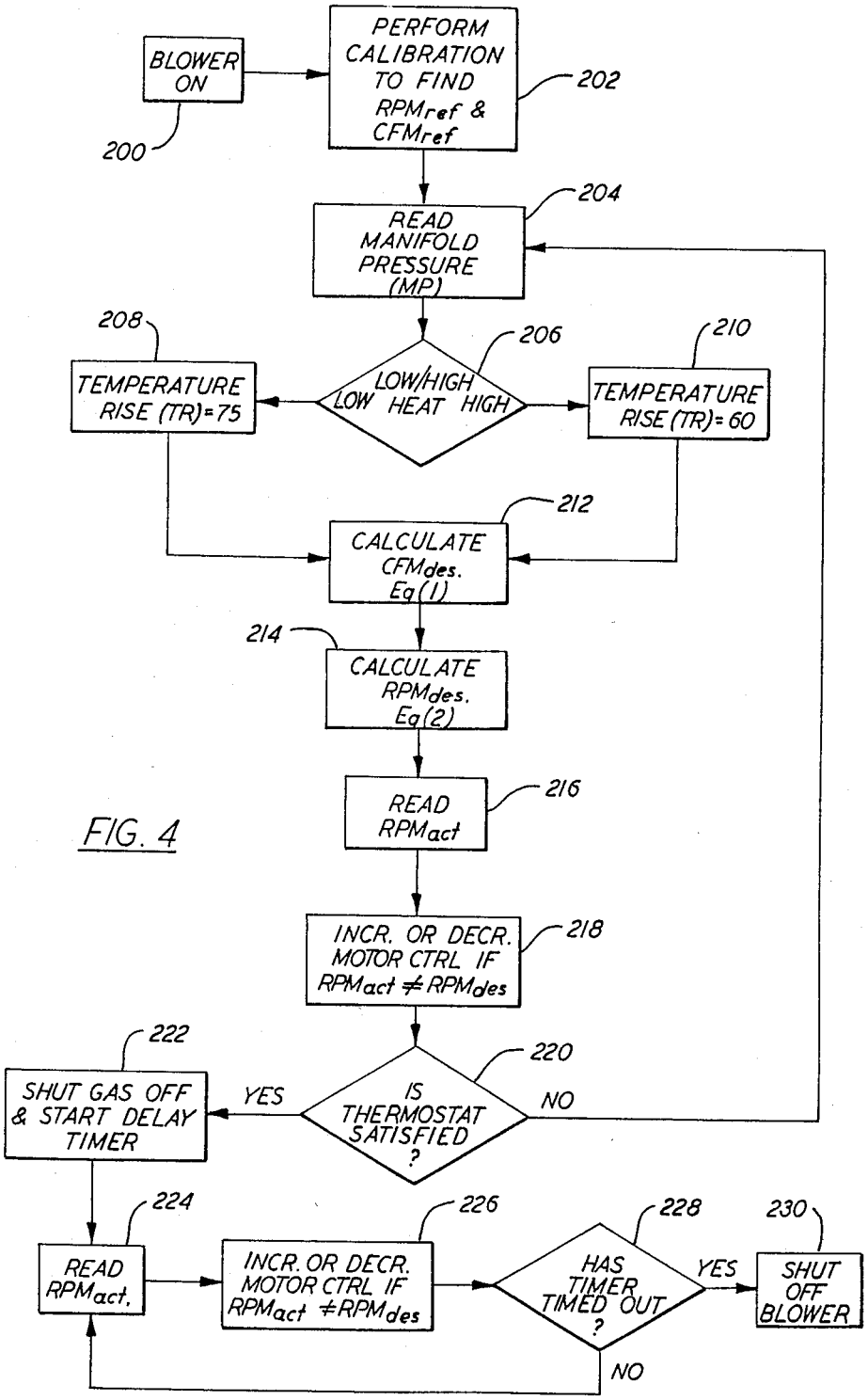
FIG. 4 is a flow diagram of the operation of the present invention.

Referring now to FIG. 4, the overall control of the furnace 10 will now be described. Assuming that lever 92 has been rotated counterclockwise to enable the gas regulator 16, the closing of the contacts of thermostat 150 responsive to the sensing of a heating need will initiate the operation of ECM blower motor 25 of air blower 26, as indicated by box 200. A calibration using the techniques of the above-identified copending applications Ser. Nos. 809,466 or 877,613 or other suitable techniques determines $RPM_{ref}$ and $CFM_{ref}$, as indicated by box 202. As indicated by box 204, the manifold pressure, MP, is then read by transducer 146 through pressure tap 144, as previously described, and the information is supplied to microprocessor control 148 which, additionally, uses it for controlling the gas regulator 16. The microprocessor control 148 controls the gas regulator 16 according to the system needs so that the furnace 10 can be operating in a low heat or a high heat mode, and this must be determined as indicated by box 206. Whether the furnace is in the high heat or low heat mode will be determined according to the disclosure of above-identified application Ser. No. 803,374. If the furnace is in the low heat mode the temperature rise should be 75 F.°, as indicated by box 208, whereas if the furnace is in the high heat mode the temperature rise should be 60 F.°, as indicated by box 210. The lower temperature rise in the high heat mode is accounted for by the greater mass of air being supplied by blower 26 in the high heat mode which translates into a greater amount of heat even though the temperature rise is less. $CFM_{des}$ is then calculated by using equation 1, as indicated by box 212. The $RPM_{des}$ is then calculated by using equation 2, as indicated by box 214. $RPM_{act}$ is then read, as indicated by box 216, and if $RPM_{act} \neq RPM_{des}$, air blower motor control 160 increases or decreases the speed of ECM 25, as indicated by box 218. As indicated by box 220, the thermostat satisfaction is determined and if the thermostat is unsatisfied the logic returns to box 204, but if the thermostat is satisfied the gas is shut off and the delay timer is started, as indicated by box 222. $RPM_{act}$ is read, as indicated by box 224, and air blower motor control 160 increases or decreases the speed of ECM 25, as required, if $RPM_{act} \neq RPM_{des}$, as indicated by box 226. This is done so that the residual heat in the heat exchanger will be delivered to the area to be heated. As indicated by box 228, if the timer has not timed out, the logic returns to box 224, otherwise the blower is shut off as indicated by box 230.

Although the present invention has been specifically described in terms of a condensing furnace, it can be used in other furnaces. It is, therefore, intended that the present invention is to be limited only by the scope of the appended claims.

What is claimed is:

1. A method for providing a variable output gas-fired furnace means with a constant temperature rise and efficiency where the furnace means includes burners, a blower, a thermostat and a delay timer, the method comprising the steps of:

sensing the temperature in an area to be conditioned;

comparing the sensed temperature to a predetermined set point;

if the sensed temperature deviates from the predetermined set point by more than a predetermined amount, gas is supplied to the burners and the blower is started;

determining the reference revolution per minute of the blower;

determining the reference cubic feet per minute delivered by the blower;

determining the manifold pressure;

determining whether the furnace is in a high heat or a low heat mode of operation;

determining the desired cubic feet per minute delivered by the blower for the current mode of operation;

reading the actual revolution per minute of the blower;

adjusting the speed of the blower motor if the actual and desired revolution per minute of the blower are not the same;

determining whether the thermostat is satisfied;

if the thermostat is not satisfied, returning to the step of determining the manifold pressure; and if the thermostat is satisfied, shutting off the gas and starting the delay timer.

2. The method of claim 1 further included the steps of:

continuing to adjust the speed of the blower if the actual and desired revolution per minute of the blower are not the same until the delay timer times out; and shutting off the blower when the delay timer times out.

* * * * *